United States Patent [19]

Harrold

[11] 4,350,838

[45] Sep. 21, 1982

[54] ULTRASONIC FLUID-ATOMIZING COOLED POWER TRANSFORMER

[75] Inventor: Ronald T. Harrold, Murrysville, Pa.

[73] Assignee: Electric Power Research Institute, Inc., Palo Alto, Calif.

[21] Appl. No.: 163,902

[22] Filed: Jun. 27, 1980

[51] Int. Cl.[3] ..... H01F 27/10

[52] U.S. Cl. ..... 174/15 R; 165/104.33; 336/58

[58] Field of Search ..... 174/15 R, 16 R; 336/57, 336/58; 165/104.33, DIG. 14; 239/102

[56] References Cited

U.S. PATENT DOCUMENTS 2,990,443 6/1961 Camilli ..... 174/15 R

*Primary Examiner*—Laramie E. Askin

*Attorney, Agent, or Firm*—L. P. Johns

[57] ABSTRACT

A vapor-cooled power transformer characterized by a transformer within a sealed housing, and means for applying ultrasonic vibrations to a dielectric liquid within the housing in order to vaporize the fluid and to apply it to the exposed surfaces of the transformer.

11 Claims, 9 Drawing Figures

ULTRASONIC FLUID-ATOMIZING COOLED POWER TRANSFORMER

This invention was conceived during the performance of work under Contract No. RP-930-1 for the Electric Power Research Institute.

CROSS-REFERENCE TO RELATED APPLICATION

This application is related to copending application Ser. No. 163,901, filed June 27, 1980 of R. T. Harrold and Lawrence E. Ottenberg, now U.S. Pat. No. 4,296,003.

BACKGROUND OF THE INVENTION

1. Field of the Invention

This invention relates to vapor-cooled electrical apparatus and, more particularly, it pertains to a vapor-cooled power transformer.

2. Description of the Prior Art

Existing gas-insulated, vapor-cooled power transformers require a pump to spray insulant onto the core and coils, and at start-up require sulphur hexafluoride ($SF_6$) gas for insulation, such as disclosed in U.S. Pat. Nos. 3,819,301; 3,834,835; and 2,845,472. A disadvantage of such a system is that it requires a conventional mechanical pump which, comprising moving parts, may incur reliability problems. Also, although $SF_6$ has a high dielectric strength, its presence reduces the cooling efficiency of the system.

As a result of the foregoing, a need exists for gas-insulated, vapor-cooled transformers that are of comparable efficiency and more fire resistant than conventional oil-filled transformers. The need is particularly opportune because polychlorinated biphenol, which was used as an insulant in many transformers, has been banned due to its non-biodegradable characteristics. In addition, only a small quantity of fluorocarbon, an inert, fireproof, vaporizable liquid, is required for both cooling and insulation in vapor-cooled transformers.

Recirculating systems having a pump are used to continuously spray a liquid coolant onto the windings and core where the coolant vaporizes upon contact. The heavier than air vapors carry off heat into cooling tubes where the vapors condense. The liquid then drains back to a sump from where it is recirculated to the windings. As the transformer load increases, the pressure of the coolant vapor increases which improves the dielectric strength. However, when a vapor-cooled transformer is first switched on, especially at low temperature ($<0°$ C.), depending upon load conditions, there may be a time lag of from 10 to 45 minutes before the dielectric strength of the vapor is adequate. Consequently, $SF_6$, which has a high dielectric strength, has been added for the initial period of the time lag, but this reduces the cooling efficiency.

SUMMARY OF THE INVENTION

It has been found in accordance with this invention that a vapor-cooled power transformer or other electrical apparatus may be provided which comprises a housing forming a sealed chamber, a heat-producing member within the chamber, a quantity of dielectric fluid within the chamber and vaporizable within the normal operating temperature range of said member, piezoceramic means for applying ultrasonic vibrations to the dielectric fluid such that the fluid atomizes and contacts the heat-producing member, and cooling means for condensing the vaporized fluid.

The advantage of the device of this invention is that an acoustic fountain of insulant together with a micromist and vapor can be created for cooling and insulating electrical apparatus without the need for a pump and the presence of $SF_6$ gas.

DESCRIPTION OF PREFERRED EMBODIMENTS

Figure 1:
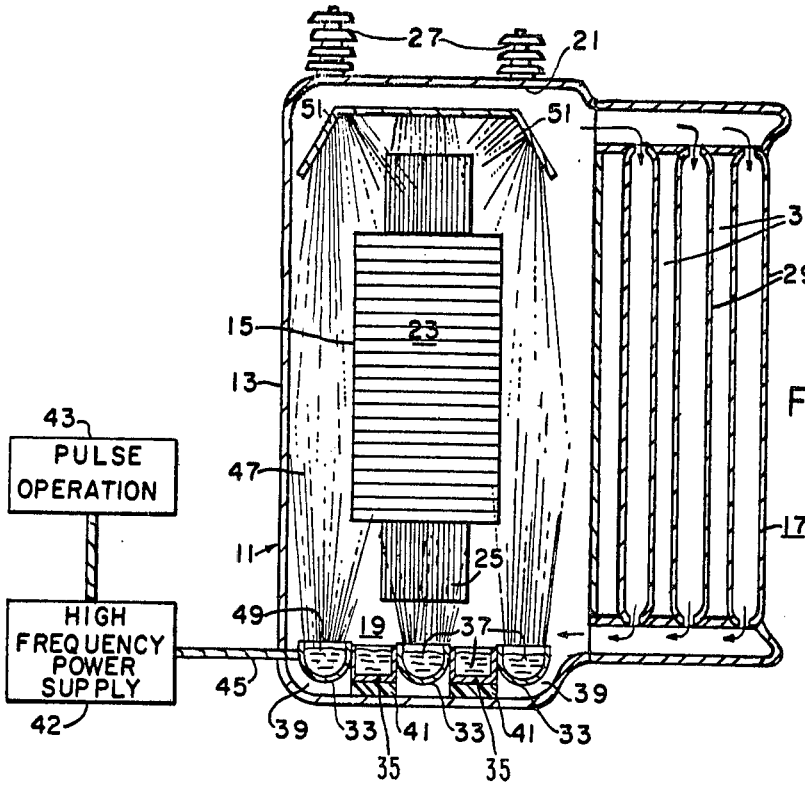
FIGS. 1–6 are vertical sectional views showing various embodiments of this invention.

In FIG. 1, a power transformer is generally indicated at 11 and it comprises a sealed housing 13, electric heat-developing apparatus such as a transformer 15, and a condenser cooler 17. The power transformer 11 also comprises means 19 for applying ultrasonic vibrations. The housing 13 is a sealed enclosure providing an internal chamber 21 in which the transformer 15, the condenser cooler 17, and the means 19 are disposed. The housing 13 is comprised of a suitable rigid material such as a metal or glass fiber.

The transformer 15 includes a magnetic core and coil assembly having electric windings 23 which are disposed in inductive relation with a magnetic core 25. For simplification, the drawings do not show a support structure or electric leads to the windings 23 and a pair of electric bushings 27 are shown by way of example for two or more similar bushings.

The condenser cooler 17 comprises a plurality of tubes 29 separated by spaces 31 through which ambient gases, such as air, circulate in heat exchange relation with the contents of the tubes. The upper ends of the tubes communicate with the upper portion of the chamber 21 and the lower ends communicate with the lower portion of said chamber, whereby vapor and mist enter the upper ends of the tubes and, upon condensation, drain into the lower portion of the chamber to be recycled as vapor as set forth hereinbelow.

In accordance with this invention, the means 19 for applying ultrasonic vibration is disposed at the lower end portion of the housing 13 and is comprised of at least one ultrasonic vibration-producing device or transducer 33. A suitable piezoceramic member is PZT-4 which is a product of the Piezoelectric Division of Vernitron Corporation, Bedford, Ohio. The preferred form of the device 33 is a piezoceramic member having a concave or bowl-shaped configuration for focusing ultrasonic vibrations onto the surface of a suitable insulant liquid contained therein. A plurality, such as six, bowl-like devices or bowls 33 are located in the lower portion of the chamber 21. The devices 33 are spaced from each other and the spaces are occupied by containers 35 which, like the devices 33, are filled with suitable insulant liquid 37. The upper peripheral portions of the bowls 33 and the containers 35 are in liquid-tight contact so that the level of the liquid in the devices and containers is maintained at a preselected depth. The containers 35, being filled with insulant liquid 37, serve as reservoirs for the devices 33. As the liquid condenses in the cooler 17, it returns to the containers 35 where the liquid overflows into the several devices 33 where proper liquid level is maintained for optimum vapor production. The devices 33 are supported above spaces 39 filled with a material having a low acoustic impedance in relation to the liquid, such as air or $SF_6$. Several containers 35 are supported on material 41 such as polytetrafluoroethylene (Teflon).

The devices 33 are powered by a power supply 42 having a pulse device 43 associated therewith. A power cable 45 extends from the power supply 42 to the ultrasonic vibration-producing devices 33 which are comprised of piezoceramic material. When power is received by the devices 33, the ultrasonic vibrations generated are directed and focused by the bowl-like configurations thereof onto the surface of the insulant liquid 37. As a result, the liquid 37 is cavitated and atomized by the high frequency sound waves which cause the surface portions of the liquid to be agitated and projected upwardly to form an acoustic fountain 47 of micromist and vapor molecules in the chamber 21 around and above the transformer windings 23 and core 25 as well as onto the surfaces of crevices and openings therein.

The devices 33 have a preferred diameter of about 10 cm. and operate in the range of from about 0.1 to about 5 MHz frequency. The devices are provided with a backing of air or $SF_6$ so that acoustic energy is directed toward a focal point 49. An arrangement of devices 33 may include six equally spaced bowls operated via a high frequency power supply of about 1 kilowatt. The exact input power varies and an arrangement of focusing devices as well as operating frequency depends upon other factors such as the liquid used. A suitable liquid for this purpose is tetrachloroethylene ($C_2Cl_4$).

The acoustic fountains 47 may operate continuously with operation of the transformer 15, or on the other hand, depending upon the pumping efficiency, pulsed operation is possible with a high repetitive rate when the transformer is first switched on, and lower rates are used later when the core and coils are at normal operating temperatures. To ensure adequate electrical strength of the micromist at the beginning of operation, the acoustic fountain 47 of mist may be activated perhaps 10 seconds or so before the transformer is energized by using a timing sequence. The acoustic fountains 47 project about 1 meter in height and may be used in conjunction with strategically placed deflectors 51 to ensure adequate coverage of the coil 23 and core 25.

As the transformer continues to operate, the micromist and vapors fill the internal chamber 21, (the micromist vaporizes upon contact with the hot surfaces of the core and windings) and the vapors then pass across the top of the chamber into the condenser cooler 17, where in contact with the tubes 29, the vapors condense, drain to the bottom of the cooler, and return to the lower or sump area of the transformer for recycling.

Figure 2:
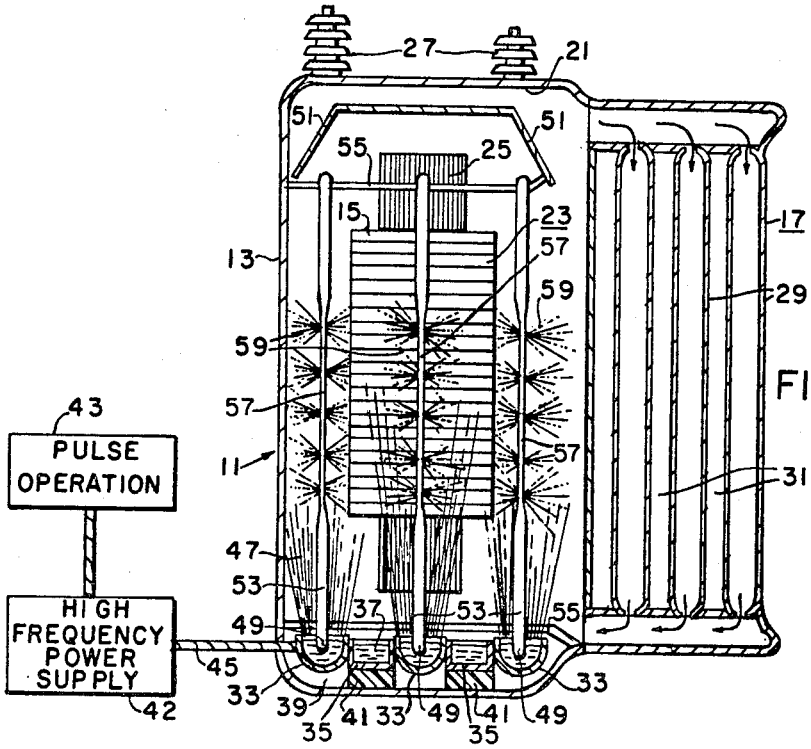

Another embodiment of the invention is shown in FIG. 2 and includes a dielectric tube 53 for each device 33 which tube projects upwardly from the surface of the insulant liquid 37. The several tubes 53 are supported in a suitable means, such as by frames 55, so that the lower ends of the tubes 53 project from the surface of the liquid 37 at the focal point 49 of the ultrasonic vibrations. The lower and upper portions of the tubes are enlarged with an intermediate portion 57 having a reduced diameter. The tubes 53 are comprised of a fiberglass, polyester composition or similar material which concentrates the acoustic vibrations from the liquid 37 at the intermediate portion so that droplets of insulant mist 47 project radially at 59 and are sprayed onto the coil or windings 23 and core 25. This method of atomizing liquids was reported by R. W. Wood and A. L. Loomis, (The Physical and Biological Effects of High Frequency Sound Waves of Great Intensity), Philosophical Magazine and Journal of Science 8.7, volume 4, November 22, September 1927, pp. 417–436, in surroundings other than a transformer.

In the vapor-cooled transformer 15, the dielectric tubes 53 are coated with the insulant liquid 37 from the acoustic fountains 47 whereby the fog and micromist from the jets improve operation of the transformer. Other forms of tubes may be used for producing spray and fog in selected regions of the transformer core and coils, such as a spiral configuration of the tubes around the core and coils.

Figure 3:
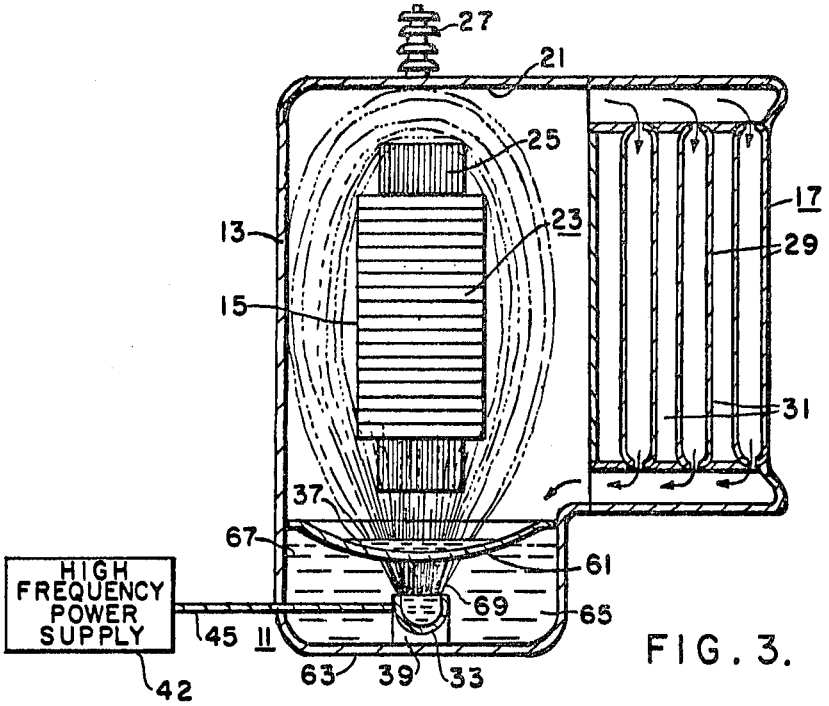

Another embodiment of the invention is disclosed in FIG. 3 and provides a diaphragm 61 extending across the lower portion of the internal chamber 21 and spaced above a bottom wall 63, with the diaphragm 61 separating the lower portion of the power transformer 11 in a fluid-tight manner. The diaphragm 61 is comprised of a flexible material such as a glass fiber-epoxy mixture. A suitable acoustic energy coupling liquid 65, such as mineral oil, fills the lower portion of the transformer housing 13 to a level 67 slightly above the lower arcuate portion of the diaphragm 61. An ultrasonic vibration-producing device 33 is suitably mounted within the liquid so that in operation, liquid vibrations 69 are focused on and project against the diaphragm 61 to cause insulant liquid 37 on the top surface of the diaphragm to be cavitated, atomized, and projected upwardly to form an acoustic fountain 47 into the upward chamber 21 and around the transformer 15.

Figure 4:
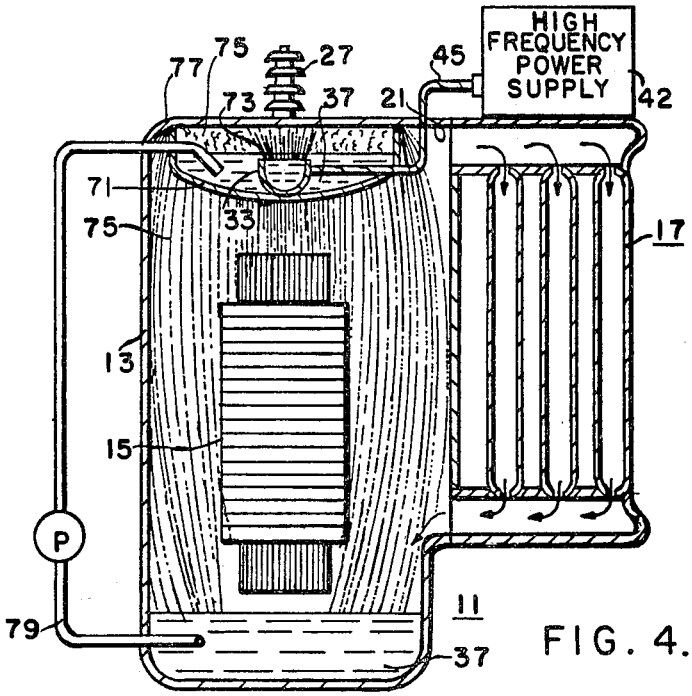

Another embodiment of the invention is shown in FIG. 4 which shows the insulating liquid 37 contained within a concave partition or diaphragm 71 on which liquid and ultrasonic vibration-producing device 33 is immersed on the upper surface of the partition 71. In operation, a beam 73 of vibrations projects to the surface of the liquid 37, causing the liquid to cavitate to form a micromist 75 which moves laterally under a top surface 77 of the housing 13 and into the chamber 21 through openings (not shown) in the partition 71. Once the micromist 75 is in the chamber 21, it surrounds and deposits upon the several surfaces of the core and coil of the transformer 15. The resulting vapor entering the cooler 17 condenses and flows to the lower portion of the housing 13 where pump means including a conduit 79 returns the liquid 37 to the upper level within the partition 71.

Figure 5:
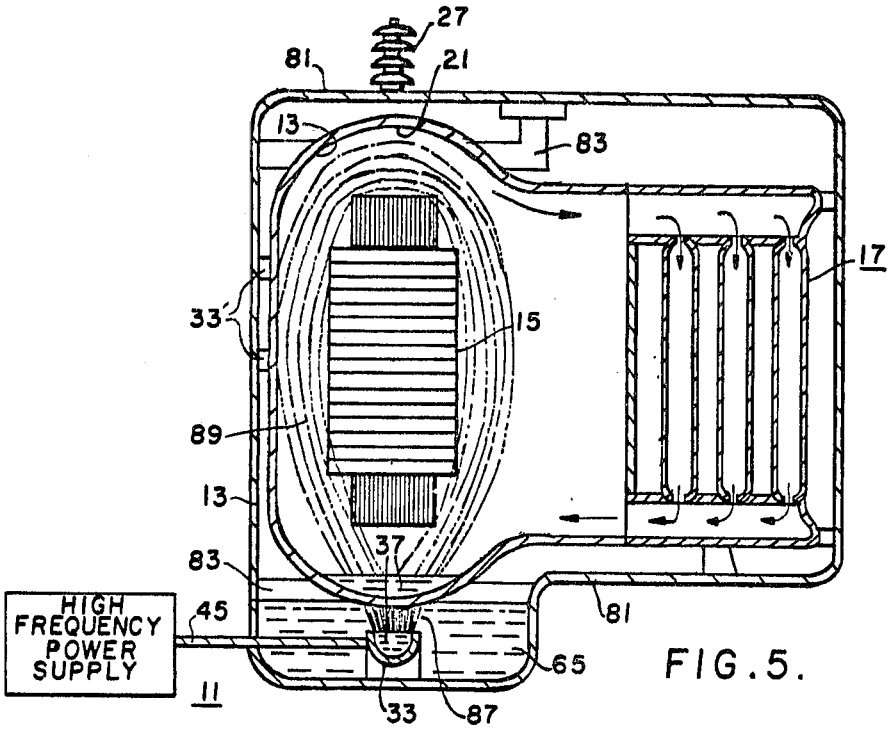

Still another embodiment of the invention is disclosed in FIG. 5 which differs from that of FIGS. 1–4 in that an outer housing or casing 81 encloses the inner housing 13 including the cooler 17. Reinforcing frames 83 support the inner housing 13 in place within the outer housing 81. The ultrasonic vibration-producing device 33 is disposed between the outer and inner housings 81, 13 where it is immersed in the liquid 65, such as mineral oil, whereby vibrations 87 from the device 33 are transmitted to the bottom outer surface of the inner housing, whereupon the insulant liquid 37 within the inner housing is cavitated to form a vapor or mist 89 which surrounds and deposits upon the several surfaces of the transformer 15. As in the prior embodiments, undeposited micromist portions move to the condenser cooler 17 from where they drain to the bottom surface of the inner housing 13. The inner container 21 is formed of a material which will accept acoustic energy and cavitate and atomize liquid on its inner surface, such as a polyester/fiberglass material of from about 1 to 3 mm. thick. The outer case may be metallic, such as steel. Additional piezoceramic elements, such as indicated at 33', may be disposed to locally atomize liquid on the inner surface of container 21.

Figure 6:
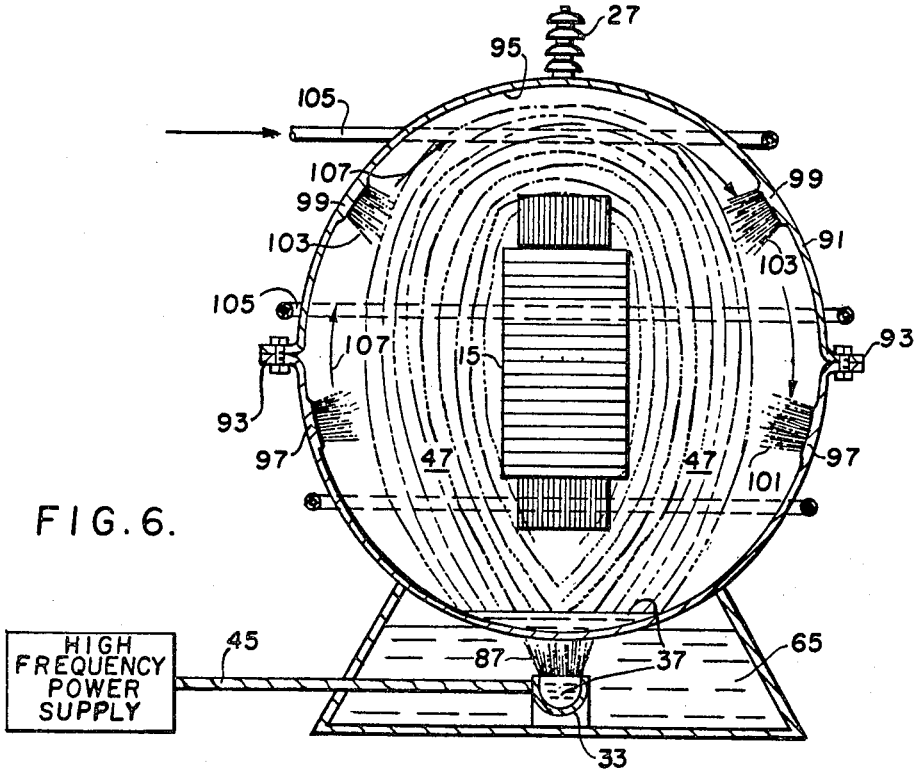

Another embodiment of the invention is shown in FIG. 6 which comprises a housing 91 having a global configuration consisting preferably of upper and lower globe portions secured together at similar flanges 93. The housing 91 is preferably a spherical or lenticular tank of a mixture of polyester and glass fiber having a thickness of approximately from 1 to 5 mm. The tank may be of any other suitable material which accepts acoustic energy and then cavitates the atomized fluid on the inner surface. In operation, an ultrasonic vibration emanating from the device 33 is transmitted through vibrations 87 to the lower surface of the housing 91. The vibrations act upon the insulant liquid 37 within the tank which liquid is cavitated and atomized to project upwardly into the housing chamber 95. The vibrations are also transmitted through the housing per se. By providing restricted or reduced wall portions 97, 99, the vibrations are concentrated and act upon the micromist or vapor 47 filling the chamber 95 to produce localized sprays or jets 101, 103 which project toward the transformer 15. Cooling tubes 105 are disposed externally of the housing 91 so that as the acoustic fountain 47 of micromist circulates as indicated by arrows 107, the micromist and vapor are condensed on the inner surface and the condensate drains to the bottom of the housing where the cycle is renewed. The jets or sprays 101, 103 are formed from the partially or fully condensed vapor or micromist and further project the micromist into contact with the transformer 15.

In all embodiments, similar reference numbers refer to similar parts.

Figure 7:
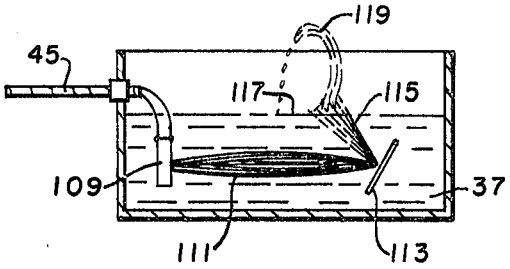
FIGS. 7, 8, and 9 are schematic views showing the various ways in which a piezoceramic oscillator may be used to create and maintain an acoustic fountain of micromist and vapor.
Figure 8:
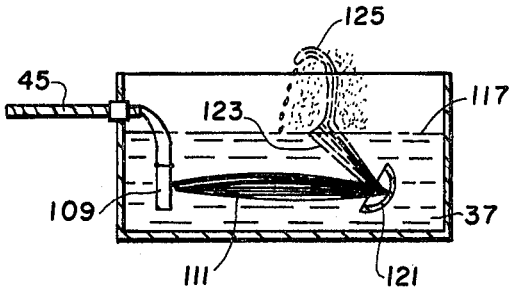
Figure 9:
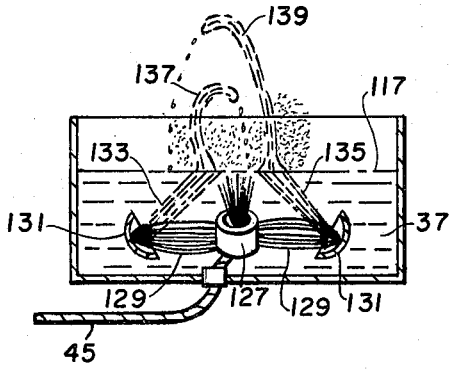

Various methods for forming the acoustic fountains 47 which are applicable to vapor-cooled power transformers are illustrated in FIGS. 7, 8, and 9. An emitter 109 (FIG. 7) of ultrasonic vibrations is immersed in the insulant liquid 37 for transmitting a beam 111 of ultrasonic vibration to a reflector 113 which directs a reflected portion 115 of the beam to a liquid-air interface 117 where the liquid is cavitated and atomized to form an acoustic fountain 119 of the liquid in the form of vapor and micromist which projects upwardly into the transformer chamber. The reflector 113 is a flat plane so that the reflected portion 115 spreads outwardly as it reaches the liquid-air interface 117.

In FIG. 8, the emitter 109 of piezoceramic material transmits a beam 111 of ultrasonic vibrations to a reflector 121 which is concave and projects a reflected portion 123 of the beam 111 to the liquid-air interface 117, where the insulant liquid is cavitated and vaporized to project micromist and atoms upwardly in the form of an acoustic fountain 125. Inasmuch as the reflector 121 is concave, the reflected portion 123 is focused to a smaller area of the liquid air interface 117 than in the embodiment of FIG. 7.

In FIG. 9, an emitter 127 is immersed in the insulant liquid 37. The emitter 127 of piezoceramic material is tubular and projects an omnidirectional beam 129 to spaced reflectors 131. The reflectors 131 are preferably concave for projecting separate reflected portions 133, 135 of the beams 129 to the liquid-air interface 117. The reflected portions 133, 135 may be directed to either one surface area or separate areas (as shown) for cavitating and atomizing the liquid at the surfaces into one or separate acoustic fountains 137, 139 of micromist and vapor in the manner disclosed hereinabove.

The various methods of forming acoustic fountains illustrated herein range from methods of projecting ultrasonic vibrations directly from an ultrasonic vibration-producing device 33 to the use of reflectors having either central plane reflecting surfaces or focusing concave reflector surfaces for directing ultrasonic means to the liquid-gas interface.

In a practical vapor-cooled power transformer, the level of insulant liquid in the sump region may vary, and consequently, to maintain an efficient acoustic fountain, it would be desirable to have a variable focus ultrasound beam. This may be achieved either electronically by cycling through a frequency range close to the focusing piezoceramic operating frequency, or by focusing piezoceramic bowls which are employed at different depths in the insulant liquid.

In conclusion, the foregoing sets forth a method for using ultrasonic vibration-producing devices, such as a piezoceramic material, for cooling and insulating a vapor-cooled power transformer. It is understood that other electrical apparatus may be cooled similarly by vaporization methods, such as for X-ray equipment, and radar, using high voltage for momentary cooling, and also arc quenching of circuit breakers.

What is claimed is:

1. A vaporization-cooled electrical apparatus comprising:

a housing forming a sealed chamber;

a heat-producing electrical member disposed within the chamber;

a quantity of dielectric fluid within the chamber and vaporizable within the normal operating temperature range of said member; and means for applying ultrasonic vibrations at the quantity of dielectric fluid such that the fluid atomizes and contacts the heat producing member.

2. The apparatus of claim 1 in which there are cooling means for the condensing of the vaporized fluid.

3. The apparatus of claim 2 in which the cooling means are in fluid communication with the chamber.

4. The apparatus of claim 3 in which the means for applying ultrasonic vibrations includes a piezoceramic oscillator for directing an ultrasonic beam at the fluid.

5. The apparatus of claim 4 in which the piezoceramic oscillator has a concave surface for directing atomized fluid onto the member.

6. The apparatus of claim 5 in which the concave surface projects beams of atomized fluid onto the member.

7. The apparatus of claim 6 in which deflector means are disposed within the chamber for directing the beams onto the member.

8. The apparatus of claim 7 in which the oscillator is immersed in the dielectric fluid such that an ultrasonic beam is directed to the surface of the fluid from where a fountain of atomized fluid extends in the chamber and onto the member.

9. The apparatus of claim 8 in which the ultrasonic beam is directed to a reflector which is immersed in the fluid and from which the ultrasonic beam is reflected to the surface of the fluid such that a fountain of atomized fluid projects upwardly from the surface and onto the member.

10. The apparatus of claim 4 in which a dielectric tube is disposed in the chamber with one open end in fluid communication with the surface of the fluid so as to receive projected atomized fluid, and the tube includes opening means at locations spaced from the one open end for spraying the atomized fluid onto the member.

11. The apparatus of claim 7 in which a transducer is dispersed in a liquid separated from the vaporizable dielectric fluid by a solid interface, with the transducer focusing acoustic energy onto the interface to atomize the dielectric fluid.

* * * * *